US007214114B2

(12) United States Patent
Gibson

(10) Patent No.: US 7,214,114 B2
(45) Date of Patent: May 8, 2007

(54) BUOYANCY ELEMENT AND MODULE

(75) Inventor: Robert Gibson, Bolton (GB)

(73) Assignee: Trelleborg CRP Ltd., Lancashire (GB)

( * ) Notice: Subject to any disclaimer, the term of this patent is extended or adjusted under 35 U.S.C. 154(b) by 0 days.

(21) Appl. No.: 10/486,490

(22) PCT Filed: Sep. 16, 2002

(86) PCT No.: PCT/GB02/04212

§ 371 (c)(1),
(2), (4) Date: Aug. 20, 2004

(87) PCT Pub. No.: WO03/025331

PCT Pub. Date: Mar. 27, 2003

(65) Prior Publication Data

US 2004/0266290 A1 Dec. 30, 2004

(30) Foreign Application Priority Data

Sep. 15, 2001 (GB) ..... 0122377.5
Feb. 13, 2002 (GB) ..... 0203398.3

(51) Int. Cl.
*B63B 22/00* (2006.01)

(52) U.S. Cl. ..... 441/133

(58) Field of Classification Search ..... 114/357
See application file for complete search history.

(56) References Cited

U.S. PATENT DOCUMENTS 2,330,106 A * 9/1943 Bernstein et al. ..... 428/134
3,294,489 A * 12/1966 Millington et al. ..... 423/447.4
3,639,331 A * 2/1972 Hattori et al. ..... 523/209
3,766,000 A * 10/1973 Gibson et al. ..... 428/368
3,773,090 A 11/1973 Ghersa et al.
3,840,426 A * 10/1974 Flautt et al. ..... 442/331
4,057,450 A 11/1977 Lee
4,448,911 A * 5/1984 Haines et al. ..... 523/411
4,474,129 A 10/1984 Watkins et al.
4,477,207 A 10/1984 Johnson
4,505,617 A 3/1985 Miller et al.
4,634,314 A 1/1987 Pierce
4,743,499 A * 5/1988 Volke ..... 428/317.3
4,768,455 A 9/1988 Maxson et al.
5,165,821 A 11/1992 Fischer et al.
5,195,843 A 3/1993 George et al.
5,226,751 A 7/1993 Doleshal
5,722,794 A 3/1998 Friederich et al.
5,875,728 A 3/1999 Ayers et al.
6,004,074 A 12/1999 Shanks, II
6,030,145 A 2/2000 Stewart, Jr. et al.
6,057,393 A * 5/2000 Hirai ..... 524/414

(Continued)

FOREIGN PATENT DOCUMENTS

EP 0 375 118 A2 6/1990

(Continued)

*Primary Examiner*—Stephen Avila
(74) *Attorney, Agent, or Firm*—Blakely, Sokoloff, Taylor & Zafman; Stephen M. De Klerk

(57) ABSTRACT

A buoyancy element (200) is disclosed which comprises a moulded body of plastics-composite material incorporating reinforcement (202) comprising at least one elongate flexible member or filament, embedded in the body and adapted to retain fragments of the buoyancy module together following structural failure of the module.

30 Claims, 7 Drawing Sheets

U.S. PATENT DOCUMENTS

| | | | |
|---|---|---|---|
| 6,155,748 | A | 12/2000 | Allen et al. |
| 6,199,595 | B1 | 3/2001 | Baker |
| 6,213,157 | B1 | 4/2001 | Thiebaud et al. |
| 6,435,775 | B1 | 8/2002 | Nish et al. |
| 6,457,527 | B2 | 10/2002 | Wells |
| 6,551,029 | B2 | 4/2003 | Shu et al. |
| 6,821,055 | B2 * | 11/2004 | Oram ..... 405/195.1 |
| 2002/0115365 | A1 | 8/2002 | Nish et al. |

FOREIGN PATENT DOCUMENTS

| | | |
|---|---|---|
| WO | WO 00/31169 | 6/2000 |

* cited by examiner

BUOYANCY ELEMENT AND MODULE

This Application is a National Phase of International Application No. PCT/GB02/04212, filed on Sep. 16, 2002, which claims priority from Great Britain Patent Application No. 0122377.5, filed on Sep. 15, 2001, and Great Britain Patent Application No. 0203398.3, filed on Feb. 13, 2002.

The present invention relates to buoyancy modules and particularly to buoyancy modules for attachment to a subsea conduit such as a riser used in offshore drilling operations.

In offshore drilling operations, e.g. oil extraction, a drill string is guided between sea floor and surface within a marine drilling riser.

The riser is normally assembled from a number of similar sections or "joints". These joints are usually manufactured using carbon steel as the principal construction material. In deep waters, the use of steel in combination with the extended length of the drilling riser produces a structure which has a significant weight in water. In order to prevent the string from buckling, it is supported by the surface vessel through a set of riser tensioners. However, in order to ensure that the required tension lies within reasonable bounds, the net weight in water of the riser is reduced by adding subsurface buoyancy. The tensions to be supported by the surface vessel are thereby reduced.

This buoyancy is added to the riser joints in the form of discrete modules. The modules themselves are constructed from low density composite foams such as syntactic foam. These materials have a limited structural strength and their use in what is a very demanding environment, where rough handling occurs, has led to difficulties being encountered due to module damage.

The handling, deployment and recovery of damaged buoyancy modules has given rise to operator concerns with regard to the safety of drilling personnel.

The buoyancy modules are typically configured as elongate cylinders. Conventionally each module is supplied as two similar, generally semi-circular halves which are in turn known as buoyancy elements. A typical buoyancy module 10 is illustrated in FIG. 1 and comprises first and second buoyancy elements 12, 14 which together define an axial recess or cavity 16 receiving and fitting to a drilling riser 18. Studs 20 pass through the elements 12, 14 and secure one to the other to retain the module 10 on the riser 18. Alternatively, elements 12, 14 could be secured to one another by circumferential straps surrounding both modules and received in annular recesses 22 defined within the buoyancy module 10. Additional axial recesses 24 may be provided through the module 10 to accommodate auxiliary lines 25 (when present) which form part of the riser bundle. Further recesses may be provided to accommodate guidance equipment.

A "string" comprising several buoyancy modules juxtaposed and abutting at their end faces is in practice fitted to a riser and constrained against axial motion by half shell clamps fitted at the outermost end of the string.

The buoyancy elements are normally constructed with a low-density syntactic foam core encapsulated within a protective external skin.

Problems have been encountered when handling drilling riser joints with buoyancy modules attached:

a) extreme local loadings have been sustained by the buoyancy elements causing smaller sections to be broken away from the main element structure. These extreme local loadings are normally caused when an object or structure impacts with a buoyancy module during handling;

b) extreme global loadings have been sustained by the buoyancy modules which have led to major failures of the element structure (e.g. significant cracks or, in extreme cases, the element being broken into two sections). These loadings have normally been generated as the riser joint has bent during offshore handling.

It is desired to reduce the likelihood of buoyancy element structural failure.

It is additionally or alternatively desired to reduce the dangers and problems posed by buoyancy element structural failure.

In accordance with a first aspect of the present invention, there is a buoyancy element comprising a moulded body of plastics-composite material incorporating reinforcement, comprising at least one elongate, flexible member or comprising elongate, flexible filaments, embedded in the body and adapted to retain fragments of the buoyancy element together following structural failure of the module.

In this way the dangers associated with buoyancy module failure can be reduced and the module may, if it fails in situ, be retained together for retrieval or repair.

It has been found, somewhat unexpectedly, that such reinforcement can dramatically increase the strength and the deformation which can be accommodated prior to breakage.

The term "filament" should be understood in this context to refer to a material comprising thin elongate, flexible strands or members.

Preferably the reinforcement has a pre-treatment whereby absorption of the plastics material of the body by the reinforcement is prevented.

In this respect the reinforcement is to be contrasted with e.g. conventional glass or carbon fibre reinforcement of plastics mouldings, wherein the reinforcing fibres are securely bonded to, and effectively integrated in, the surrounding plastics mouldings. In buoyancy elements according to this preferred feature of the present invention the properties of the reinforcement—particularly its flexibility and in some embodiments also its elasticity—are advantageously retained.

Preferably, the reinforcement comprises a branched network of members or filaments. A branched network can securely anchor itself in the buoyancy element even if not firmly bonded to it. The preferred form of such reinforcement is a mesh.

The most preferred material for the reinforcement is nylon, more specifically a knotless nylon mesh. In the absence of pre-treatment the fibrous nylon filaments would absorb resin during moulding of the buoyancy element, thereby becoming bonded to the surrounding moulding and losing their inate flexibility. By pre-treating the nylon such absorption and bonding are prevented. Experiments have shown this to be highly advantageous with regard to the strength and resistance to breakage of the buoyancy element.

In the event that exceptional loading nonetheless leads to breakage of the buoyancy element, the reinforcement can serve to retain the pieces of the broken element together in one unit, an important safety consideration. Because its flexibility and in some embodiments elasticity is retained in the moulding process the reinforcing filaments resist being broken along with the surrounding moulding, the invention again offering advantages in this respect over more convention fibre reinforced materials.

The reinforcement is preferably arranged in a layer at or adjacent the surface of the moulding. In the most preferred embodiment the buoyancy element comprises an outer skin of fibre reinforced material and the reinforcement according to the present invention is arranged in a layer beneath this skin. The fibre reinforcement may be of conventional type such as glass or carbon.

The reinforcement is most preferably pre-treated by soaking in oil prior to moulding of the buoyancy element. In this way absorption and bonding between the moulding and the reinforcement contained therein are avoided.

Preferably the reinforcement is non water degradable. Water may enter the buoyancy element and it is especially preferred that the reinforcement should not be destroyed by the action of salt water. Nylon is again a highly suitable material in this respect.

The reinforcement may comprise at least one elongate, linear tendon.

The tendon is preferably substantially straight.

Preferably, the tendon is provided with an external skin and separated thereby from the surrounding plastics-composite material.

In this way absorption of resin during moulding by the tendon is prevented, preserving the tendon's mechanical properties.

Preferably the skin comprises a material which is softened at temperatures created by heat given off upon curing of the plastics material of the body.

Preferably, the tendon extends along an axial direction of the buoyancy element.

Preferably, the tendon extends along substantially the full length of the buoyancy element. In accordance with a second aspect of the present invention there is a buoyancy module for mounting on an underwater conduit, the module comprising at least two buoyancy elements for assembly around the conduit such that the conduit is received in an elongate cavity defined between the buoyancy elements, and a pair of spacer elements which are separated from each other along the length of the cavity, have surfaces for seating upon the riser or conduit, and project inwardly from a wall of the cavity to thereby separate the cavity wall from the riser or conduit, the spacer elements comprising resilient material such that their seating surfaces are able to deflect to conform to curvature of the conduit and so reduce bending moment exerted on the buoyancy module.

The spacer elements may each comprise a separate component from the buoyancy elements, e.g. an annular collar.

The spacers may be integrally formed with moulded buoyancy elements, the resilient material being incorporated during moulding.

In accordance with a third aspect of the present invention, there is a buoyancy module for mounting on an underwater conduit in a string comprising two or more such modules arranged end-to-end, the buoyancy module being provided with means for transmitting force to its neighbouring module in the string in a direction along the length of the conduit while facilitating angular deflection of the module relative to its neighbour.

In a particularly preferred embodiment the means for transmitting force to the neighbouring module is formed by an end face of the buoyancy module, which is tapered or curved to facilitate angular deflection of the module relative to its neighbour. The end face may for example be frusto-conical or radiussed.

In a further preferred embodiment, the means for transmitting force to the neighbouring module comprises a resilient spacer for placement between end faces of the module and its neighbour. The spacer is preferably annular.

In accordance with a fourth aspect of the present invention, there is a buoyancy module for mounting on an underwater conduit, the module comprising at least two buoyancy elements for assembly around the conduit such that the conduit is received in a cavity defined therebetween, and the buoyancy elements comprising moulded plastics composite bodies incorporating reinforcing framework, mesh or members whereby following structural failure of the buoyancy module fragments thereof are retained together.

Specific embodiments of the present invention will now be described, by way of example only, with reference to the accompanying drawings, in which:

FIG. 1 is a view along a radial direction of a known buoyancy module mounted upon a riser, internal features of the module being shown in phantom;

FIGS. 1*a*–1*c* are respectively an end view of, and two radial sections through, the known buoyancy module along arrows A—A, B—B and C—C of FIG. 1;

Figure 15:
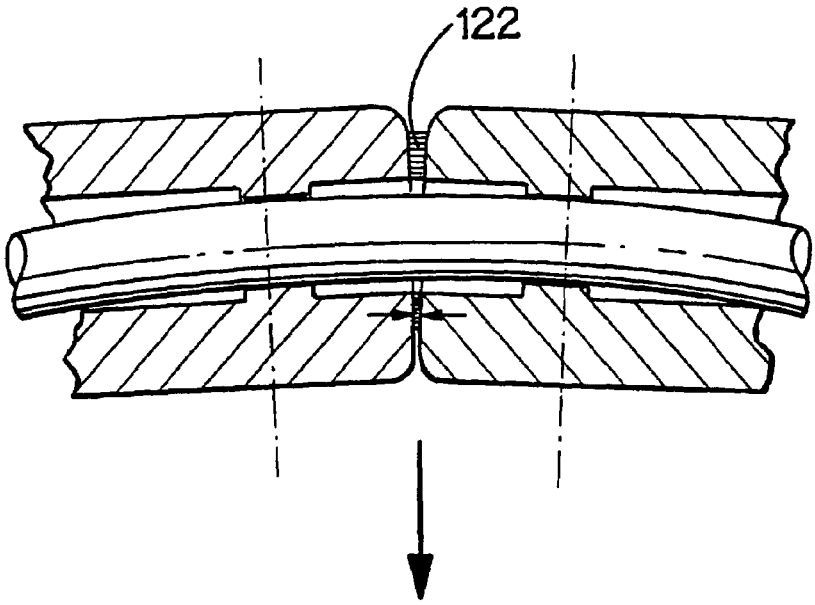
FIG. 15 is an axial section through neighbouring portions of a pair of buoyancy modules mounted upon a riser with, in accordance with an aspect of the invention, a buffer disposed between the modules.
Figure 15A:
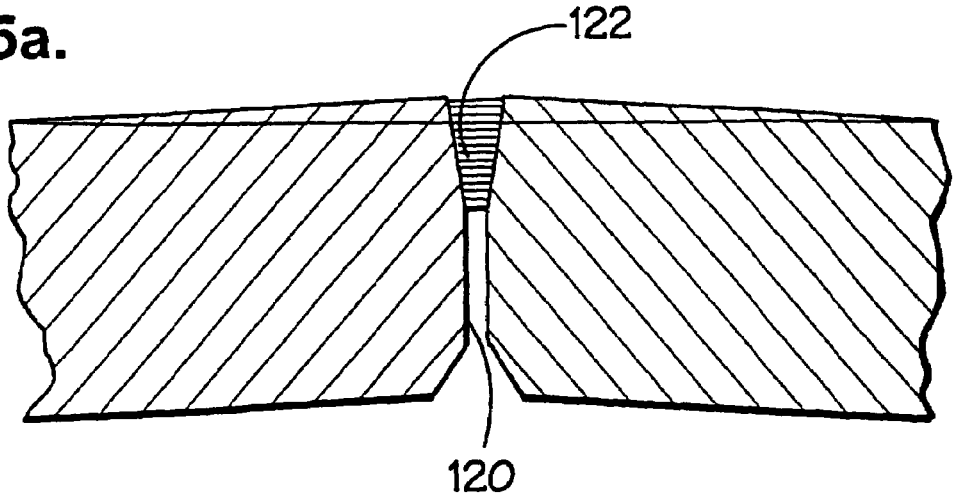
Figure 16:
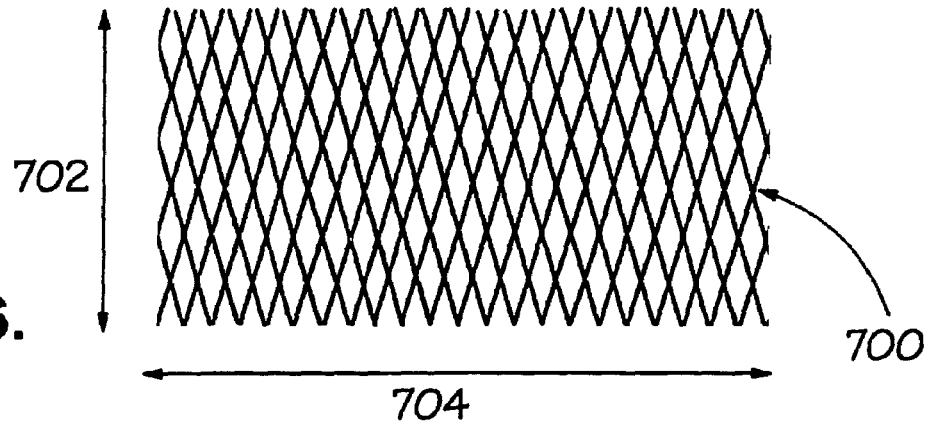
Figure 17:
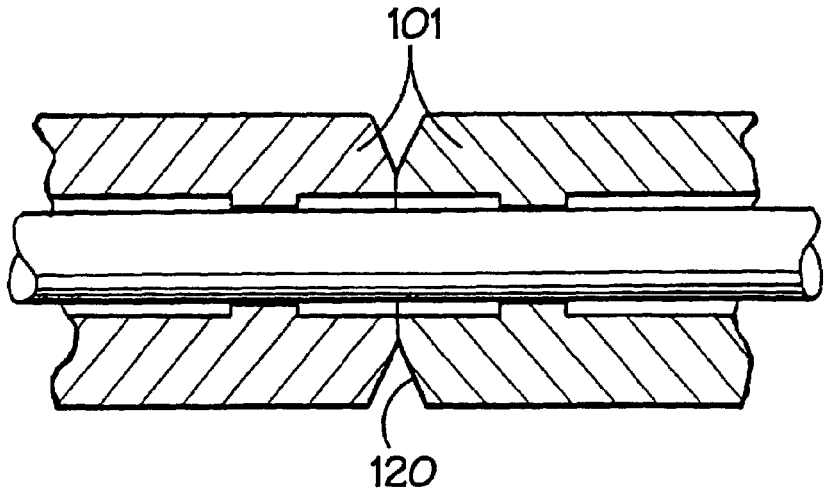
Figure 18:
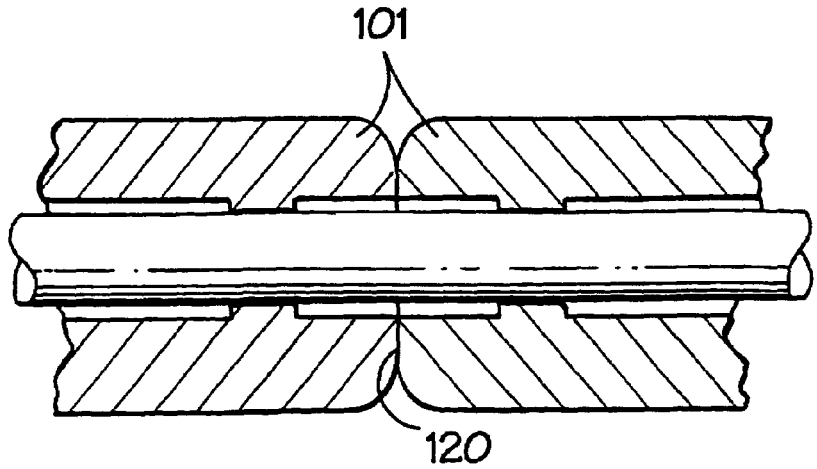

FIG. 15*a* is an enlarged view of a portion of the buffer;

FIG. 16 is a plan view of a mesh used in certain embodiments of the invention;

FIG. 17 is a side view of an end region of a buoyancy module embodying an aspect of the present invention; and FIG. 18 is a similar side view of a further buoyancy module embodying an aspect of the present invention.

It has been recognised by the inventors that one way to reduce the danger posed by structural failures of buoyancy modules, and to enable retrieval and repair of the modules, is to hold a fractured buoyancy element together until it can be retrieved for repair or replacement.

Figure 1:
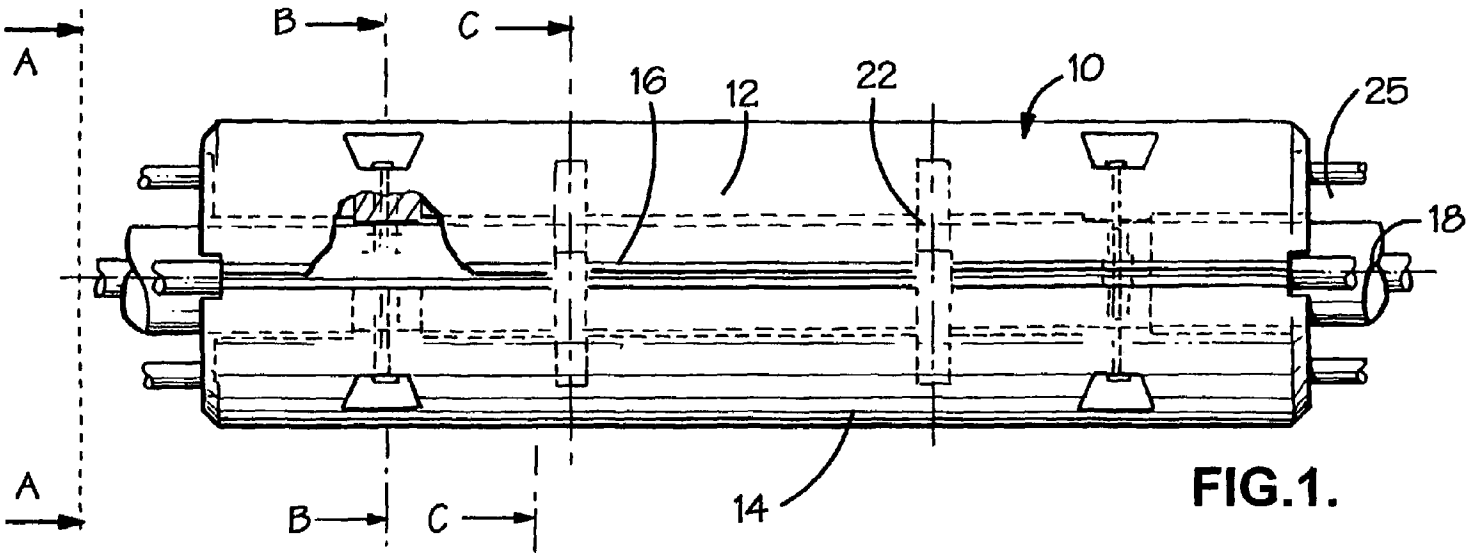
Figure 1C:
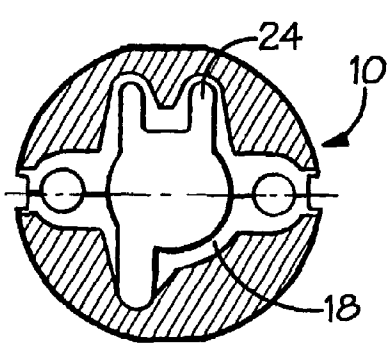
Figure 1B:
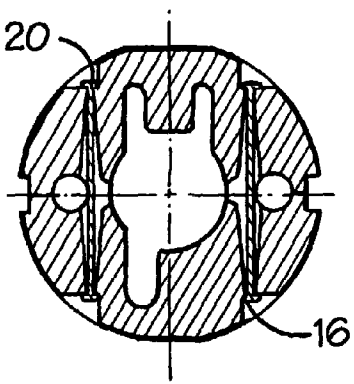
Figure 1A:
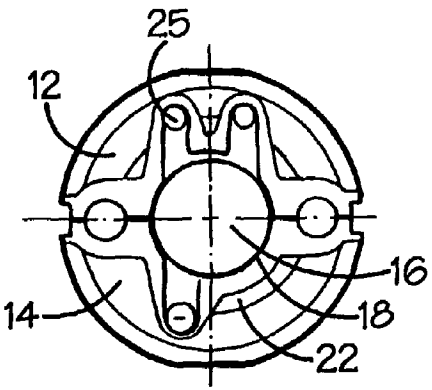
Figure 2:
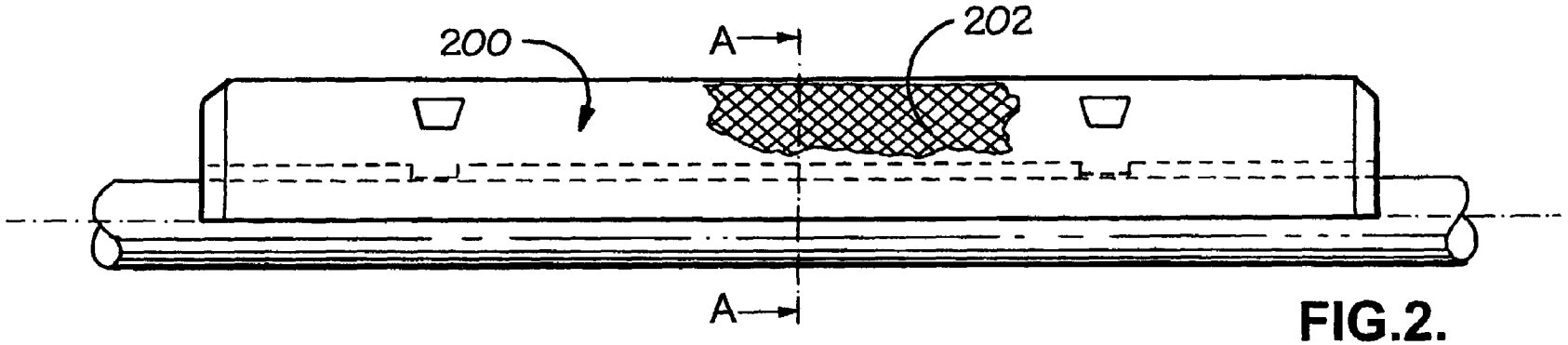
FIG. 2 is a partly cut-away view along a radial direction of a buoyancy element embodying an aspect of the present invention, mounted on a riser.
Figure 3:
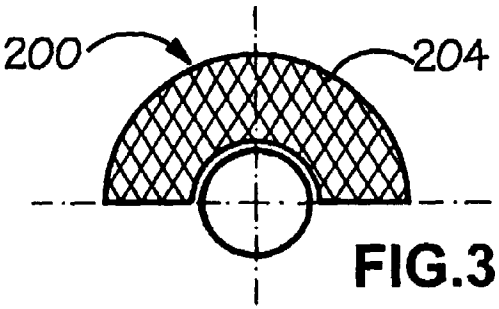
FIG. 3 is a radial section through the buoyancy element illustrated in FIG. 2 along arrows A—A.

FIGS. 2 and 3 illustrate a buoyancy element 200 which, in accordance with an aspect of the present invention, incorporates an external security mesh formed as a flexible structural mesh 202 within the element's external skin 204.

The illustrated mesh covers the entire area of the skin 204. Alternatively partial coverage may be utilized.

The purpose of the mesh 202 is as follows:

a) to retain small pieces of foam material which may become detached from the body of the buoyancy element; and /or b) to hold large sections of the buoyancy element together in the case of catastrophic failure of the buoyancy element.

Figure 5:
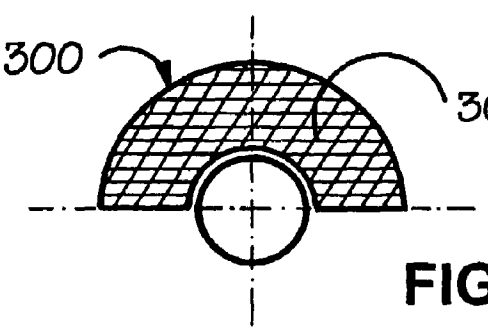
FIG. 5 is a radial section through the buoyancy element illustrated in FIG. 4 along arrows B—B.
Figure 4:
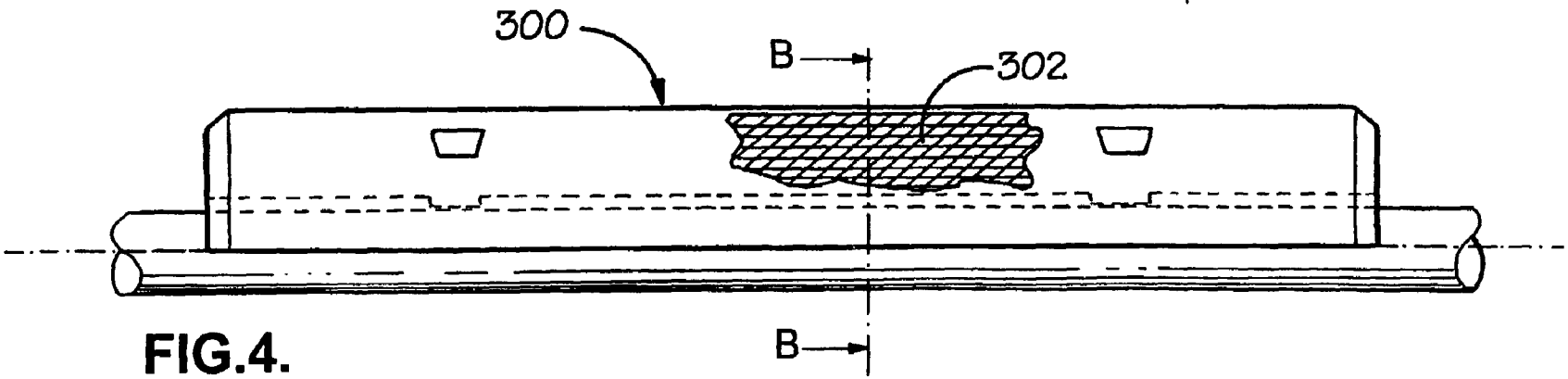
FIG. 4 is a partly cut-away view along a radial direction of a further buoyancy element embodying the present invention mounted on a riser.

FIGS. 4 and 5 illustrate a further buoyancy element 300 which, in accordance with a further aspect of the present invention, incorporates an internal security structure of mesh 302. This takes the form of a 3-dimensional, random or regular, structural space frame, which partially occupies: the space within the element external skin.

As with the external securing mesh, the function of the structure is to hold the buoyancy element structure together whilst in a fractured condition.

Figure 10:
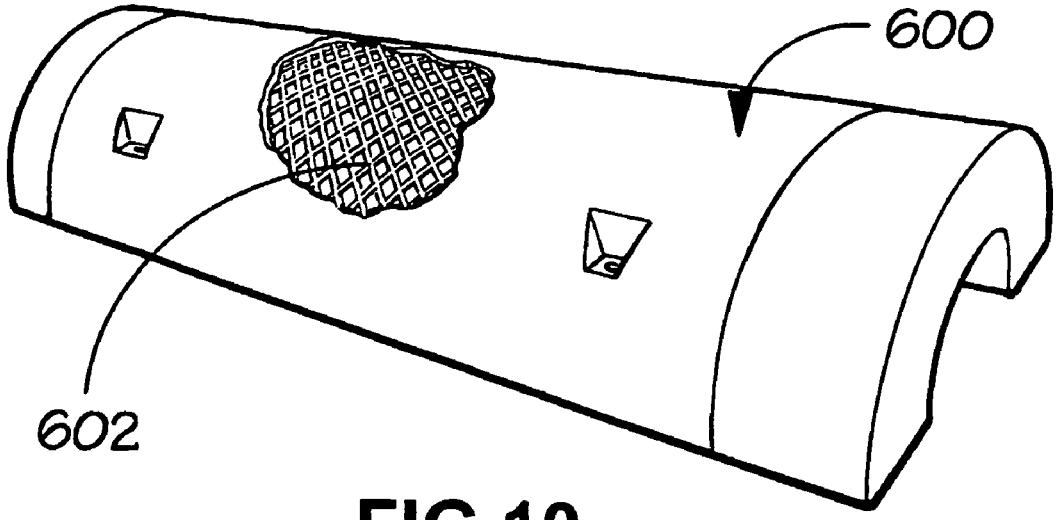
FIG. 10 is a perspective illustration of a further buoyancy element embodying an aspect of the present invention, partly cut away to reveal internal structure thereof.
Figure 11:
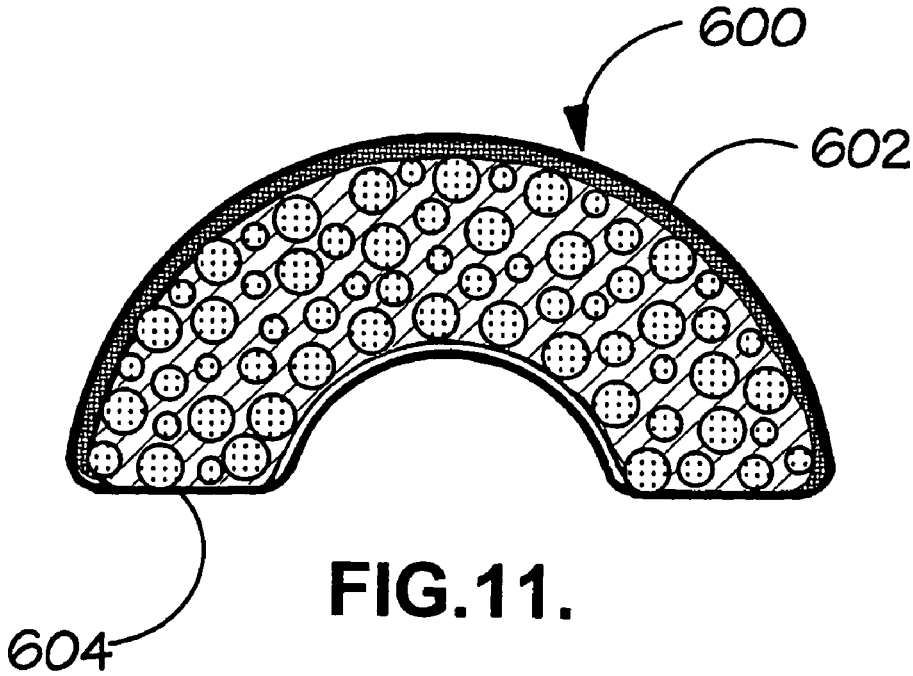
FIG. 11 is a cross section through the buoyancy element illustrated in FIG. 10.

FIGS. 10 and 11 illustrate in a little more detail the currently favoured embodiment of this aspect of the invention. The illustrated buoyancy element 600 is again moulded from syntactic foam. In a conventional manner the element has an outermost skin of fibreglass. Immediately beneath this is a security mesh 602 formed of knotless nylon.

The nylon of the mesh is fibrous and would absorb the syntactic foam were it not for a pre-treatment stage in which the mesh is soaked in oil. The currently preferred material is a millimetre square mesh. The mesh is in this embodiment a knotless mesh formed from sheet material. A repeat pattern of 30 millimetres is suitable, although this dimension is not critical. With reference to FIG. 16, the mesh 700 has a taut direction 702 along which it is relatively stiff under tension and a flexible direction 704 along which it is less still under tension. The mesh is installed with its flexible direction 702 lying generally along the length of the buoyancy element—i.e. with this direction of the mesh axially aligned with respect to the element.

The moulding procedure involves cutting the mesh to fit the outer circumference of the buoyancy elements. Sufficient pieces of mesh are cut to line the entire outside diameter of the mould. The setting is then immersed in mineral oil for 5–8 minutes to fully saturate it, and hung to allow excess oil to drip off. Release agent is applied to the mould followed by lining thereof with a glass fibre mat, to form the integral outer skin of the buoyancy element. The reinforcing mesh is then laid upon the glass fibre mat and secured thereto, staples being the preferred means of securing. Macrospheres 604 partially fill the mould, serving to reduce overall density of the finished buoyancy element, and a known syntactic foam resin is poured into the mould in a low pressure environment (reduced air pressure preventing the formation of air bubbles in the moulding). The syntactic foam is in this embodiment a mixture of an epoxy and small microspheres which serve to reduce the density of the foam. Such materials are in themselves well known.

Were it not for the oil pre-treatment, the low pressure environment in which moulding takes place would promote absorption of the resin by the nylon mesh. Without the pre-treatment the mesh would become integrated with the surrounding material and would lose its flexibility and elasticity, becoming hardened by absorbed plastics material. Due to the pre-treatment, the mesh retains its flexibility and elasticity and is not bonded to the surrounding syntactic foam, which can be verified by breaking a sample of the moulding and observing that the mesh is released thereby from the moulding.

Importantly the mesh serves a twofold purpose. Firstly it significantly increases the strength of the buoyancy element. Secondly the mesh is resistant to breakage and, following structural failure of the buoyancy element, can retain the broken pieces together as a unit and thereby prevent them from causing injury e.g. by falling.

As in a vehicle windscreen, which uses layers of relatively soft plastics material between harder layers of toughened glass to spread the loading due to impacts and so prevent breakage, the properties of the, relatively hard, syntactic foam and the flexible mesh within it are complementary, the mesh serving to distribute loading through the buoyancy element and resist structural failure.

Figure 6:
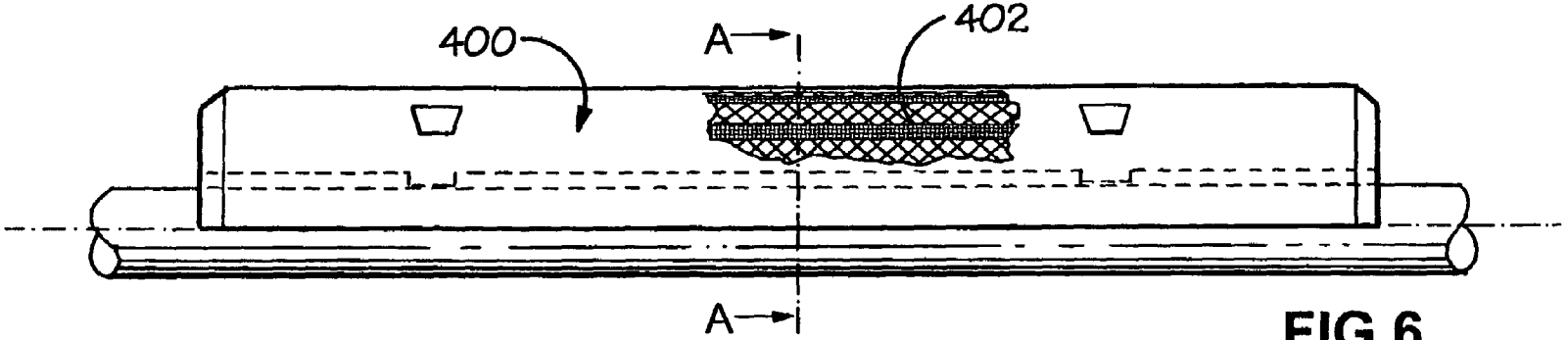
FIG. 6 is a partly cut-away view along a radial direction of a further buoyancy element embodying the present invention, mounted upon a riser.
Figure 7:
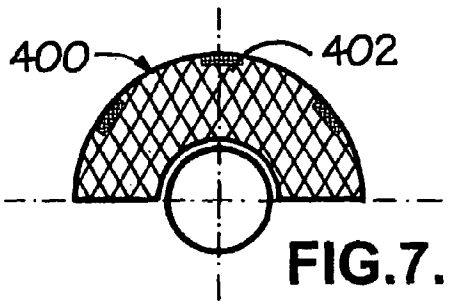
FIG. 7 is a radial section through the buoyancy element illustrated in FIG. 6 along arrows A—A.

FIGS. 6 and 7 illustrate yet a further buoyancy element 400 which, in accordance with the present invention, incorporates a set of tendons 402 in or just below the external skin of the element. The tendons 402 are linear structural members generally aligned with the longitudinal axis of the buoyancy element. The purpose of these components is to retain buoyancy element sections together in the case of catastrophic failure. Their effectiveness in the case of local limited damage to the buoyancy element is likely to be limited.

Figure 9:
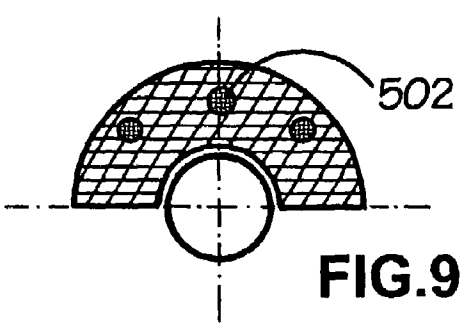
FIG. 9 is a radial section through the buoyancy element illustrated in FIG. 8 along the arrows B—B.
Figure 8:
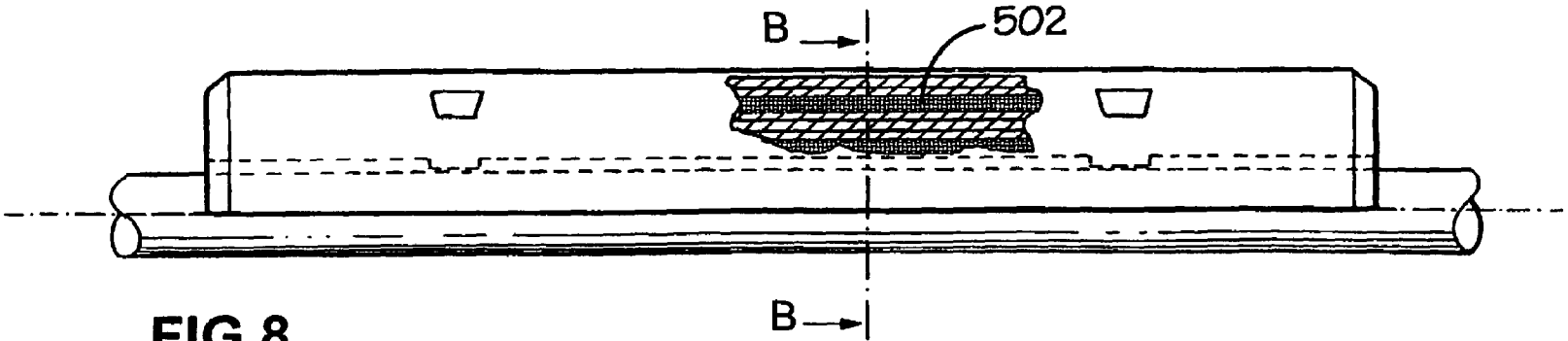
FIG. 8 is a partly cut-away view along a radial direction of yet a further buoyancy element embodying the present invention, mounted upon a riser.

The buoyancy element 500 illustrated in FIGS. 8 and 9, also embodying an aspect of the present invention, incorporates tendons 502 located within the body of the buoyancy element, some distance below the external skin. Again these are at least generally axially aligned. Their purpose is the same as that of the tendons 402 illustrated in FIG. 6. The plastics composite used in the buoyancy elements 400 and 500 is in both cases such as to bond to the internal reinforcement (tendons 402, 502).

The currently preferred form of tendon comprises a KEVLAR (registered trade mark) strap 510 which is 2 millimetres thick and 50–250, or more preferably 60–150, millimetres wide with its own form of pre-treatment—an external plastics skin 512 of EVA. Such straps are currently used in attaching certain clamps to undersea tubulars. They possess high tensile strength and elasticity, and are flexible. The plastics skin of the tendon prevents absorption of resin by the tendon itself and so allows the tendon to maintain is flexibility and elasticity. It is found that the elevated temperatures produced upon curing of the syntactic foam softens the tendon's plastics skin, producing a secure bond between the foam and the tendon. Problems of de-lamination (an important issue in modules for deep sea use, where invasion of salt water can produce de-lamination) are consequently reduced.

An alternative form of tendon comprises nylon rope. Diameters of 5–25 millimetres are preferred. It is believed that oil pre-treatment of larger diameter ropes would not be appropriate since the oil may not penetrate to the rope's centre. Hence a pre-treatment involving plastics coating of the rope would be utilized to prevent resin absorption.

An alterative/additional strategy for preventing buoyancy module failure is to prevent the module from becoming over-stressed.

Figure 12:
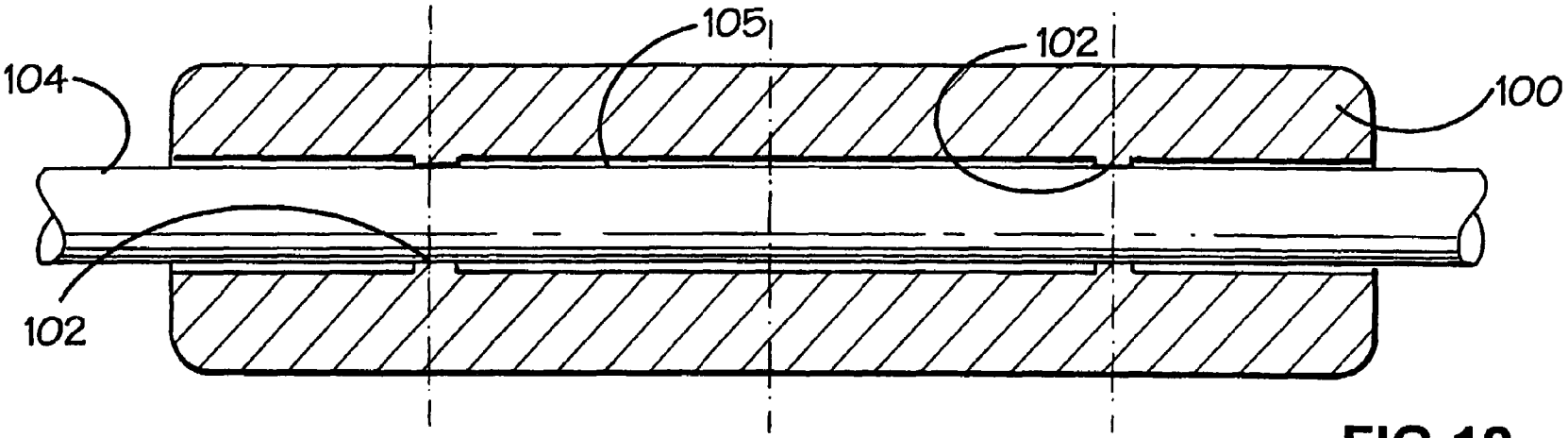
FIG. 12 is an axial section through a further buoyancy module of known type, mounted upon a riser.

One source of stress is curvature of the riser upon which the module is mounted. As FIG. 12 illustrates, buoyancy elements 100 are normally supplied with support pads 102. The pads are integrally formed circumferential upstands or flanges located towards either end of the buoyancy module and projecting radially inwardly therefrom to seat upon the riser 104.

The purpose of the pads is to provide a gap 105 between the external surface of the riser and the internal surface of the buoyancy element. When the riser pipe deflects during handling, the presence of the annular gap is intended to prevent contact with the element and in turn prevent load being transferred to this structure.

However, as the pads have a finite length, they cannot be considered to be point supports. Due to this, as the riser pipe deflects and assumes a curvature, a bending moment will be passed from the tubular to the buoyancy element via the support pad.

Figure 13:
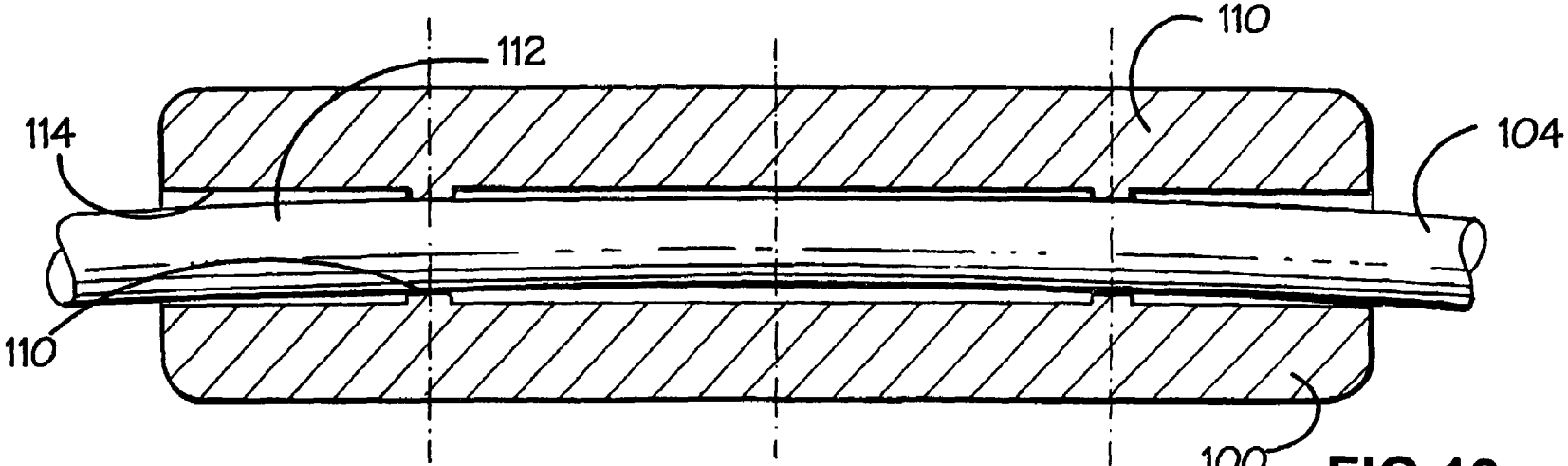
FIG. 13 is an axial section through a buoyancy module embodying an aspect of the present invention.

In the embodiment of the present invention illustrated in FIG. 13, the integrally formed support pads 102 of the known arrangement are replaced by flexible mountings 110. These may be of resilient material and may be separate components from the elements 100, attached thereto, or may be semi-integral to the element structure (e.g. being formed in the same moulding process but containing a material of greater resilience than the element as a whole). As FIG. 13 illustrates, the effect is that contact surfaces of the mountings 110, seated upon the riser 104, can deflect to conform to curvature of the riser and hence minimise bending moment exerted on the buoyancy module. The annular gap 112 between the buoyancy module and the riser 104 is chosen to avoid contact between the riser 104 and the module's inner surface 114, based on the anticipated riser curvature. The axial position of the pads is chosen to maximise their effectiveness.

A further approach to the problem of buoyancy module integrity involves consideration of forces between end faces of the modules. A single joint of a sub-sea riser is normally fitted with between 3 and 6 buoyancy modules (i.e. 6 to 12 buoyancy elements). The modules are mounted in direct contact with each other (i.e. adjacent buoyancy modules butt together without any intermediate gap being present). However, there is a gap present between the end face of the outermost module and the riser joint connecting flange. In order to prevent the buoyancy modules from moving axially (either during handling or in operation) an end clamp (or stop collar) is fitted against the exposed face of the module string.

As an alternative to this arrangement, a spacer collar may be fitted between the riser joint end flange and the end face of the buoyancy module.

When the assembly has been completed, the buoyancy module string can be considered to be held in position rigidly (i.e. relative axial movement with respect to the riser pipe is not possible).

Figure 14:
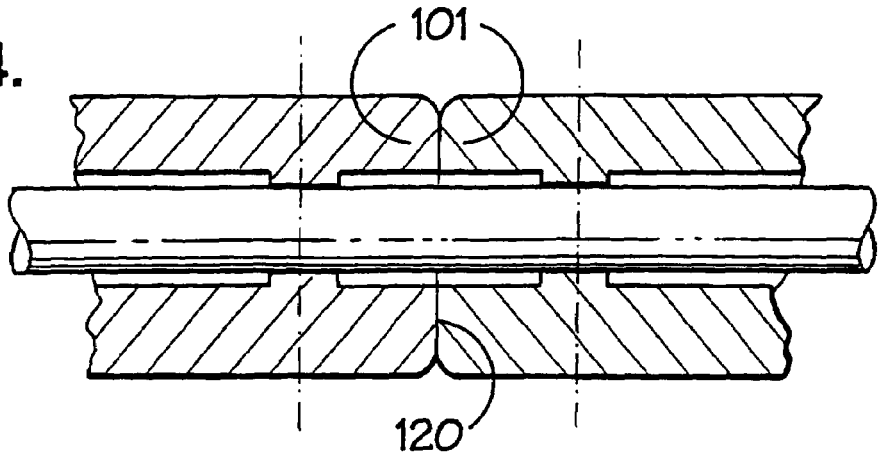
FIG. 14 is an axial section through neighbouring portions of a pair of buoyancy modules of known type mounted in conventional manner upon a riser.

FIG. 14 illustrates in axial section portions of a neighbouring pair of buoyancy modules 101 with abutting end faces 120. It will be apparent that deflection of the riser joint, e.g. during handling, causes loads to be passed between the two modules.

The presence of these loadings may either lead to:

a) failure of the buoyancy element structure local to the end face; or b) an increase in the general stress level carried by the element structure which may contribute to the global failure of the buoyancy element.

In an embodiment of the present invention the end faces are shaped to reduce local loading at the end faces upon riser deflection. This may be achieved by shaping the end face 120 with a taper (e.g. by making the end face frustro-conical as seen in FIG. 17) or a radius as seen in FIG. 18.

Contact at the interface between adjoining end faces so as to properly transmit stresses due to module weight and buoyancy remains a requirement of the module design.

FIGS. 15 and 15*a* illustrate how, in accordance with a further aspect of the present invention, a resilient end face buffer 122 may be incorporated between the end faces 120 of adjoining buoyancy modules 101. In this particular embodiment the buffer 122 comprises an annulus of resilient material.

It will be apparent that certain of the strategies explained above for improving buoyancy module performance may be implemented in combination with each other. Hence for example a module reinforced as explained with reference to any of FIGS. 1 to 11 could utilise resilient support pads and/or means for reducing loading from one module upon another.

The invention claimed is:

1. A buoyancy element comprising a moulded body of plastics-composite material incorporating reinforcement, the reinforcement comprising a branched network of elongate, flexible members or comprising a branched network of elongate, flexible filaments, the flexible member or filaments being embedded in the body and being treated in a manner which prevents it/them from being securely bonded to the surrounding plastics, such that the reinforcement is resistant to breakage in the event of structural failure of the buoyancy element and is adapted to retain fragments of the buoyancy element together following such failure.

2. A buoyancy element as claimed in claim 1 wherein the treatment of the reinforcement is such as to prevent it from absorbing the plastics material of the body.

3. A buoyancy element as claimed in claim 2 wherein the treatment of the reinforcement comprises liquid absorbed by the reinforcement.

4. A buoyancy element as claimed in claim 3 wherein the liquid comprises an oil.

5. A buoyancy element as claimed in claim 4 wherein the oil is a mineral oil.

6. A buoyancy element as claimed in claim 1 wherein the reinforcement comprises a mesh of members or filaments.

7. A buoyancy element as claimed in claim 1 wherein the members or filaments have a lateral dimension of substantially 3 millimetres or greater.

8. A buoyancy element as claimed in claim 1 wherein the members or filaments have a lateral dimension of less than substantially 1 centimetre.

9. A buoyancy element as claimed in claim 1 wherein the reinforcement comprises a layer in proximity and substantially parallel to an outer surface of the buoyancy element.

10. A buoyancy element as claimed in claim 1 comprising an integrally formed skin of fibre reinforced plastics.

11. A buoyancy element as claimed in claim 10 wherein the reinforcement is arranged within the skin.

12. A buoyancy element as claimed in claim 1 wherein the reinforcement comprises nylon.

13. A method of manufacturing a buoyancy element comprising:

providing a mould;

providing reinforcement material in the form of elongate, flexible reinforcing filaments or members;

pre-treating the reinforcement material;

arranging the reinforcement material in the mould; and introducing plastics composite material, wherein the plastics is initially in resinous form, into the mould; and curing of the plastics material; the pre-treatment serving to resist absorption of resin by the reinforcement and to prevent the reinforcement from being securely bonded to the plastics material.

14. A method as claimed in claim 13 wherein the pre-treatment comprises immersion of the reinforcement material in liquid.

15. A method as claimed in claim 13, further comprising the step of lining at least part of the mould with glass fibres, additional to the aforementioned reinforcement material, thereby to form an integral skin of glass reinforced plastics upon the buoyancy element.

16. A method as claimed in claim 15 wherein the reinforcement material is arranged upon the glass fibres.

17. A buoyancy module for mounting on an underwater conduit, the module comprising at least two buoyancy element is for assembly around the conduit such that the conduit is received in an elongate cavity defined between the buoyancy elements, and a pair of spacer elements which are separated from each other along the length of the cavity, have surfaces for seating upon the riser or conduit, and project inwardly from a wall of the cavity to thereby separate the cavity wall from the riser or conduit, the spacer elements comprising resilient material such that their seating surfaces are able to deflect to conform to curvature of the conduit and so reduce bending moment exerted on the buoyancy module.

18. A buoyancy module as claimed in claim 17 wherein the spacer elements each comprise a separate component from the buoyancy module.

19. A buoyancy element comprising a moulded body of plastics-composite material incorporating reinforcement, the reinforcement comprising at least one elongate, flexible member or comprising elongate, flexible filaments, the flexible member or filaments comprising at least one elongate, linear tendon and being embedded in the body and being treated in a manner which prevents it/them from being securely bonded to the surrounding plastics, such that the reinforcement is resistant to breakage in the event of structural failure of the buoyancy element and is adapted to retain fragments of the buoyancy element together following such failure.

20. A buoyancy element as claimed in claim 19 wherein the treatment of the reinforcement is such as to prevent it from absorbing the plastics material of the body.

21. A buoyancy element as claimed in claim 20 wherein the treatment of the reinforcement comprises liquid a absorbed b the reinforcement.

22. A buoyancy element as claimed in claim 21 wherein the liquid comprises an oil.

23. A buoyancy element as claimed in claim 19 comprising an integrally formed skin of fibre reinforced plastics.

24. A buoyancy element as claimed in claim 23 wherein the reinforcement is arranged within the skin.

25. A buoyancy element as claimed in claim 19 wherein the tendon has a lateral dimension of 5 millimetres or greater.

26. A buoyancy element as claimed in claim 19 wherein the tendon extends along an axial direction of the buoyancy element.

27. A buoyancy element as claimed in claim 19 wherein the tendon extends along substantially the full length of the buoyancy element.

28. A buoyancy element as claimed in claim 19 wherein the tendon is provided with an external skin and separated thereby from the surrounding plastics-composite material.

29. A buoyancy element as claimed in claim 28 wherein the skin comprises a material which is softened at temperatures created by heat given off upon curing of the plastics material of the body.

30. A buoyancy element as claimed in claim 19 wherein the tendon comprises a multi-filament, high tensile strength material.

* * * * *